US009784003B2

(12) United States Patent
Pendley et al.

(10) Patent No.: US 9,784,003 B2
(45) **Date of Patent: *Oct. 10, 2017**

(54) BAND SPACING IN FALL PROTECTION SYSTEM

(71) Applicant: MATE, LLC, Green Bay, WI (US)

(72) Inventors: Timothy Pendley, Madera, CA (US); Michael J. McLain, Green Bay, WI (US)

(73) Assignee: MATE, LLC, Green Bay, WI (US)

( * ) Notice: Subject to any disclaimer, the term of this patent is extended or adjusted under 35 U.S.C. 154(b) by 312 days.

This patent is subject to a terminal disclaimer.

(21) Appl. No.: 14/203,888

(22) Filed: Mar. 11, 2014

(65) Prior Publication Data

US 2015/0259933 A1 Sep. 17, 2015

(51) Int. Cl.

| | |
|---|---|
| ***E04G 21/32*** | (2006.01) |
| ***E04B 7/00*** | (2006.01) |
| ***E04B 7/02*** | (2006.01) |
| ***E04D 12/00*** | (2006.01) |
| ***E04D 13/16*** | (2006.01) |

(52) U.S. Cl.

CPC ..... *E04G 21/3261* (2013.01); *E04B 7/024* (2013.01); *E04D 12/002* (2013.01); *E04D 13/1625* (2013.01); *E04G 21/3266* (2013.01)

(58) Field of Classification Search

CPC ..... E04G 21/329; E04G 21/3204; E04G 21/3214; E04G 21/3266; E04G 21/3261; E04D 13/1625; E04B 7/024

See application file for complete search history.

(56) References Cited

U.S. PATENT DOCUMENTS

| | | | |
|---|---|---|---|
| 3,969,863 | A | 7/1976 | Alderman |
| 4,047,346 | A | 9/1977 | Alderman |
| 4,446,664 | A | 5/1984 | Harkins |
| 4,573,298 | A | 3/1986 | Harkins |
| 4,875,320 | A | 10/1989 | Sparkes |
| 5,201,152 | A | 4/1993 | Heffner |
| 5,251,415 | A | 10/1993 | Van Auken et al. |
| 5,406,764 | A | 4/1995 | Van Auken et al. |
| 5,901,518 | A | 5/1999 | Harkins |

(Continued)

FOREIGN PATENT DOCUMENTS

WO 2012145783 11/2012

OTHER PUBLICATIONS

Guardian Energy Saver FP, printed from internet Aug. 4, 2014, 23 pages.

Guardian Energy Saver FP, Roof System Installation Instructions, 2009, 4 pages Guardian Building Products Distribution, Inc., Solon, Ohio.

Silvercote Lamination, ES Energy Saver FP, brochure, Copyright 2014, 20 pages, Silvercote Laminations, Greer, South Carolina.

(Continued)

*Primary Examiner* — Robert Canfield

(74) *Attorney, Agent, or Firm* — Thomas D. Wilhelm; Northwind IP Law, S.C.

(57) ABSTRACT

This invention provides fall protection systems, in metal building construction, and methods of installing such systems. A given such system comprises a suspension fabric, supported by a grid-work of longitudinal and lateral support bands. The distance of the safety band from the rafter corresponds to about 40 percent to about 75 percent of the diameter of the bag. Thus for a 30-inch diameter bag, the distance between the edge of the rafter and the middle of the safety band is about 12 inches to about 23 inches. The safety band protects the suspension fabric from being cut by the near edge of the rafter when a falling object impacts the fall protection system near the edge of the rafter.

27 Claims, 7 Drawing Sheets

(56) References Cited

U.S. PATENT DOCUMENTS

| | | | |
|---|---|---|---|
| 5,953,875 | A | 9/1999 | Harkins |
| 6,094,883 | A | 8/2000 | Atkins |
| 6,226,945 | B1 | 5/2001 | Henry et al. |
| 6,247,277 | B1 | 6/2001 | Kerpash, Sr. |
| 6,401,426 | B1 | 6/2002 | Alderman et al. |
| 6,748,715 | B1 | 6/2004 | Black et al. |
| 8,590,245 | B2 | 11/2013 | Peng et al. |
| 2002/0020584 | A1 | 2/2002 | Cjepa |
| 2003/0114055 | A1 | 6/2003 | Burton et al. |
| 2011/0067345 | A1 | 3/2011 | Crostic, Jr. et al. |
| 2013/0108377 | A1 | 5/2013 | Steffenino |
| 2013/0305623 | A1 | 11/2013 | Pendley et al. |

OTHER PUBLICATIONS

Guardian Building Products Distribution, Inc., Guardian ES Energy Saver FP, Product Specification Sheet, Copyright 2011, 2 pages, Guardian Building Products, Greer, South Carolina.

Harris Steel, Industry properties for Steel Sheets—Cold Rolled & Hot Dipped Zinc Coated, Specification Sheet, Found by Patent Examiner Feb. 2015, 2 pages, Harris Steel.

Steelscape, A Bluescope Steel Company, Zincalume Steel Grade 50 (Class 1), Grade Data Sheet, Jul. 1, 2012, 1 page, Steelscape.

Steelscape, A Bluescope Steel Company, Zincalume Steel Grade 80 (Class 1), Grade Data Sheet, Jul. 1, 2012, 1 page, Steelscape.

Maple Leaf Sales, K-Grip 514 Flammable Foam, Product Data Sheet, received Feb. 3, 2014, 1 page.

Maple Leaf Sales II, Inc., 514 Macroplast Adhesive, Material Safety Data Sheet, dated Jul. 16, 2010, 3 pages.

BAND SPACING IN FALL PROTECTION SYSTEM

BACKGROUND OF THE INVENTION

This invention relates to buildings, building components, building subassemblies, and building assemblies, and to methods of constructing buildings. This invention relates specifically to components, subassemblies, and assemblies, as parts of the building, and to the issue of worker safety during the construction of buildings.

From time to time, injuries occur during construction of buildings, including to workers who fall from elevated heights. The focus of this invention is to enable a building contractor to reduce, desirably to eliminate, the number of incidents of worker injuries resulting from workers falling from elevated heights while working on construction of a building.

Governmental safety organizations, for example the Occupational Safety and Health Administration (OSHA) in the US, have promulgated required safety standards, and safety practices to generally provide safety systems which capture and support workers who are working at substantial heights above supporting surfaces, to protect such workers, namely to stop a fall, and to support such workers if/when such workers do fall. But it is up to the industry to create fall protection systems which meet the required standards.

Pre-engineered metal building systems are the predominant method of non-residential low rise construction for buildings. Existing fall protection standards have substantial impact on the contractors involved in such pre-engineered metal building systems.

One way a worker can be protected, according to the standards, is for the worker to wear a safety harness which is tied, by a strap, to the building structure at elevation such that the harness/strap combination stops any fall which the worker experiences before the worker encounters an underlying surface such as a floor or the ground. Use of such safety harness is known as "tying off". But tying the harness to the building limits the worker's mobility, as well as the worker's range of movement. Thus, tie-off harnesses are not viewed favorably in the industry because of worker inefficiency.

Another way workers can be protected is for the building contractor to erect safety nets in order to provide leading edge protection against falls. Cost and maintenance of such safety nets, as well as the equipment and expense required for erecting and dismantling the net and associated equipment, and moving and storing the net and equipment, can be a substantial increment in the per square foot cost of especially the roof insulation system being installed.

With the anticipation of expanded enforcement efforts by government safety officials, building erectors have increased incentive to find ways to meet the existing fall protection requirements.

Another acceptable fall protection system is a passive system wherein a fabric, such as a solid sheet, a woven sheet, or a net-like material, is suspended at or below the work area, optionally supported by a grid of crossing support bands, far enough above any underlying supporting surface to catch and support a worker who falls, thereby to act as a passive fall-protection system.

OSHA has defined a drop test procedure whereby a such passive fall protection system can be tested. According to the test procedure, a 400 pound weight is dropped onto the fall protection system under stated conditions to determine whether a given system meets the required safety standards.

For purposes of complying with government regulations, any system used as a fall protection system need only meet the OSHA-mandated standards related to dropping such 400 pound weight. Of course, the real humanitarian objective is to prevent worker injuries if/when a worker falls from an elevated work location. Thus, any fall protection system which is effective to catch and safely hold a falling worker has operational value, even if such system does not meet OSHA standards.

According to one aspect of the prior art, currently in use in the metal building industry, and intended to meet government fall protection standards, a purported fall protection system uses crossing longitudinal and lateral metal bands extending under the eave, under the ridge, and under the intermediate purlins, and a fabric is installed above the bands and under the purlins, extending across the entirety of a respective bay of the building being constructed, thereby providing a suspended fabric intended to catch and support a falling worker in that bay. Insulation is ultimately installed on the top surface of the fabric whereby the fabric ultimately functions as the vapor barrier portion of the building ceiling insulation system in the finished building.

Testing has shown that currently-available such systems meet the government-mandated drop test standard at certain locations in the bay of a metal building under construction, while failing such drop test at other locations. Typically, such systems fail the drop test adjacent an edge of the bay, where any worker accidental fall is most likely to occur.

In conventional fall protection systems known to the applicants, the system specifications require that the first lateral band, closest to a rafter, be spaced 6 inches from the respective rafter. Testing has shown that, when the mandated drop test is performed as close as possible to the rafter, the falling bag moves that first lateral band toward the rafter, allowing the edge of the rafter to act like a knife, cutting the fabric at the edge of the rafter. The overall result is failure of the fabric at the edge of the rafter.

Thus, the user of such conventional fall protection system cannot be assured that a falling worker will be caught and supported at whatever location he/she falls from, namely any work station at an elevated work location. Such failure can result in worker injury, along with the numerous detrimental results of such injury, as well as resulting government citations associated with the resulting injury, and associated monetary fines and/or assessments, civil lawsuits, and the like.

Accordingly, there is a need for a novel passive fall protection system for use during construction of metal buildings which effectively catches and supports a falling worker working at an elevated height anywhere in the corresponding bay being worked on, and which system meets all governmental safety standards.

There is further a need for a fall protection system which protects the suspension fabric from being cut by the edge of the rafter.

There is also a need to provide a portion of a building insulation system which functions to provide effective fall protection during construction of the building, while meeting the existing governmental fall protection requirements.

These and other needs are alleviated, or at least attenuated, or partially or completely satisfied, by novel products, systems, and/or methods of the invention.

SUMMARY OF THE INVENTION

This invention provides fall protection systems, in metal building construction, and methods of installing such systems. Such fall protection systems include a suspension fabric, supported by a grid-work of longitudinal and lateral support bands, used to protect workers working at heights, against falls onto underlying support surfaces, during construction of such metal buildings. The fall protection system of the invention positions the lateral bands which are closest to the rafters, or adds lateral bands in new locations closest to the rafters, in order to protect the suspension fabric from being cut by nearby rafters. Such closest lateral bands are described herein as "safety bands". The distance of the safety band from the rafter corresponds to about 40 percent to about 75 percent of the diameter of the bag. Thus for a 30-inch diameter bag, the distance between the edge of the rafter and the middle of the safety band is about 12 inches to about 23 inches.

In a first family of embodiments, the invention comprehends a fall protection system in a building roof structure, for protecting workers involved in installation of such roof structure, such building roof structure including structural roof elements which include at least first and second rafters, a space between the first and second rafters defining a first distance between the first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, the fall protection system comprising a first set of longitudinal support bands extending from the first rafter to the second rafter and being connected to the building structural roof elements, the first set of longitudinal support bands being spaced along the lengths of the first and second rafters; a second set of lateral support bands extending from the eave toward the ridge and under the intermediate purlins, the bands of the second set of support bands having first and second end portions which are spaced along the lengths of the eave and the ridge; and a suspension fabric overlying, and being supported by, the first and second sets of support bands, and being attached to the building structural roof elements, the first and second sets of support bands collectively defining a grid-work of crossing bands, a first band of the second set of lateral support bands, next adjacent the first rafter, being spaced from the first rafter by a distance of about 12 inches to about 23 inches.

In some embodiments, the safety band uses a first banding material which has a first yield strength, and the longitudinal bands, and the remaining ones of the lateral bands, use a second banding material which has a second yield strength greater than the first yield strength.

In some embodiments, the lateral bands, including the safety bands, use a first banding material which has a first yield strength, and the longitudinal bands use a second banding material which has a second yield strength greater than the first yield strength.

In some embodiments, all of the longitudinal bands, and all of the lateral bands, including the safety bands, use a banding material which has yield strength of 50 ksi to 64 ksi
tensile strength of 50 ksi to 78 ksi,
elongation of 22% to 37%, and
Rockwell B hardness of 64-79.

In some embodiments, the first band is spaced from the first rafter by a distance of about 14 inches to about 18 inches, optionally about 18 inches.

In a second family of embodiments, the invention comprehends a fall protection system in a building roof structure, for protecting workers involved in installation of such roof structure, such building roof structure including structural roof elements which include at least first and second rafters, a space between the first and second rafters defining a first distance between the first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, the fall protection system comprising a first set of longitudinal support bands extending from the first rafter to the second rafter and being connected to the building structural roof elements, the first set of longitudinal support bands being spaced along the lengths of the first and second rafters; a second set of lateral support bands extending from the eave toward the ridge and under the intermediate purlins, the bands of the second set of support bands having first and second end portions which are spaced along the lengths of the eave and the ridge; and a suspension fabric overlying, and being supported by, the first and second sets of support bands, and being attached to the building structural roof elements, the first and second sets of support bands collectively defining a grid-work of crossing bands, a first band of the second set of lateral support bands being next adjacent the first rafter, a second band of the second set of lateral support bands being next adjacent the first band, with the first band between the second band and the first rafter, a third band of the second set of lateral support bands being next adjacent the second band, with the second band being between the first and third bands, the second band being spaced from the rafter by a first distance, and the third band being spaced from the second band by a second distance which is approximately equal to the first distance.

In some embodiments, the safety band uses a first banding material which has a first yield strength, and the longitudinal bands, and the remaining ones of the lateral bands, use a second banding material which has a second yield strength greater than the first yield strength.

In some embodiments, the lateral bands, including the safety bands, use a first banding material which has a first yield strength, and the longitudinal bands use a second banding material which has a second yield strength greater than the first yield strength.

In some embodiments, all of the longitudinal bands, and all of the lateral bands, including the safety bands, use a banding material which has yield strength of 50 ksi to 64 ksi
tensile strength of 50 ksi to 78 ksi,
elongation of 22% to 37%, and
Rockwell B hardness of 64-79.

In some embodiments, the first band is spaced from the first rafter by a distance of about 12 inches to about 23 inches, optionally about 14 inches to about 18 inches, optionally about 16 inches.

In a third family of embodiments, the invention comprehends a fall protection system in a building roof structure, for protecting workers involved in installation of such roof structure, such building roof structure including structural roof elements which include at least first and second rafters, a space between the first and second rafters defining a first distance between the first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, the fall protection system comprising a first set of longitudinal support bands extending from the first rafter to the second rafter and being connected to the building structural roof elements, the first set of longitudinal support bands being spaced along the lengths of the first and second rafters; a second set of lateral support bands extending from the eave toward the ridge and under the intermediate purlins, the bands of the second set of support bands having first and second end portions which are spaced along the lengths of the eave and the ridge; and a suspension fabric overlying, and being supported by, the first and second sets of support bands, and being attached to the building structural roof elements, the first and second sets of support bands collectively defining a grid-work of crossing bands, a first band of the second set of lateral support bands being next adjacent the first rafter, a second band of the second set of lateral support bands being next adjacent the first band, with the first band between the second band and the first rafter, a third band of the second set of lateral support bands being next adjacent the second band, with the second band being between the first and third bands, the first band being spaced from the rafter by a first distance, the second band being spaced from the first band by a second distance different from the first distance, and the third band being spaced from the second band by a third distance different from the first and second distances.

In some embodiments, the safety band uses a first banding material which has a first yield strength, and the longitudinal bands, and the remaining ones of the lateral bands, use a second banding material which has a second yield strength greater than the first yield strength.

In some embodiments, the lateral bands, including the safety bands, use a first banding material which has a first yield strength, and the longitudinal bands use a second banding material which has a second yield strength greater than the first yield strength.

In some embodiments, all of the longitudinal bands, and all of the lateral bands, including the safety bands, use a banding material which has yield strength of 50 ksi to 64 ksi
tensile strength of 50 ksi to 78 ksi,
elongation of 22% to 37%, and
Rockwell B hardness of 64-79.

In some embodiments, the first band is spaced from the first rafter by a distance of about 12 inches to about 23 inches, optionally about 14 inches to about 18 inches, optionally about 16 inches.

In a fourth family of embodiments, the invention comprehends a method of protecting a suspension fabric of a fall protection system from being cut or torn at an edge of a rafter in a building roof structure when a falling object impacts the fall protection system near an edge of a building rafter, the fall protection system being designed and adapted for protecting workers involved in installation of such roof structure, such building roof structure including structural roof elements which include at least first and second ones of the rafters, a space between the first and second rafters defining a first distance between the first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, the fall protection system comprising a first set of longitudinal support bands extending from the first rafter to the second rafter and being connected to the building structural roof elements, the first set of longitudinal support bands being spaced along the lengths of the first and second rafters; a second set of lateral support bands extending from the eave toward the ridge and under the intermediate purlins, the bands of the second set of support bands having first and second end portions which are spaced along the lengths of the eave and the ridge, the suspension fabric overlying, and being supported by, the first and second sets of support bands, and being attached to the building structural roof elements, the method of protecting the suspension fabric comprising installing, as a safety band, a first one of the lateral support bands parallel to the respective rafter and at a distance of about 12 inches to about 23 inches, optionally about 14 inches to about 18 inches, optionally, about 16 inches, from an edge of the respective rafter.

In some embodiments, the method includes installing a such safety band adjacent each side of each rafter where such safety band will underlie the suspension fabric.

In some embodiments, the method includes spacing the lateral support bands at generally uniform spacings between the first and second rafters, and adding such safety bands, so spaced, as extra bands, adjacent each rafter.

In some embodiments, the safety band uses a first banding material which has a first yield strength, and the longitudinal bands, and the remaining ones of the lateral bands, use a second banding material which has a second yield strength greater than the first yield strength.

In some embodiments, the lateral bands, including the safety bands, use a first banding material which has a first yield strength, and the longitudinal bands use a second banding material which has a second yield strength greater than the first yield strength.

In some embodiments, all of the longitudinal bands, and all of the lateral bands, including the safety bands, use a banding material which has yield strength of 50 ksi to 64 ksi
tensile strength of 50 ksi to 78 ksi,
elongation of 22% to 37%, and
Rockwell B hardness of 64-79.

BRIEF DESCRIPTION OF THE DRAWINGS

Illustrative embodiments of the invention are described hereinafter, by way of example only, with reference to the accompanying drawings, wherein.

Figure 1:
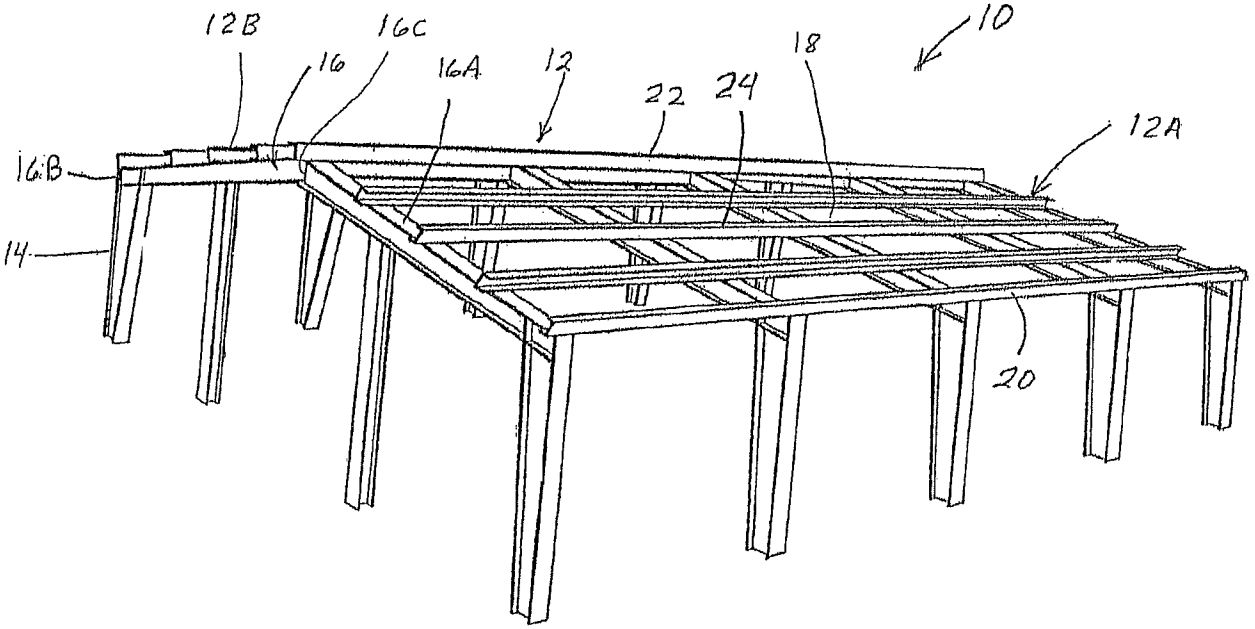
Fig. 1 PRIOR ART
FIG. 1 is a perspective view, from above the eaves, of a typical metal building structure, including columns, rafters, eaves, ridges, and intermediate purlins.

The invention is not limited in its application to the details of construction, or to the arrangement of the components, or to the methods of construction, set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

FIG. 1 illustrates the primary structural members of a typical metal building 10 having first and second roof slopes 12A and 12B. Vertical support for the structural elements of the roof, designated generally as 12, is provided by upstanding columns 14 positioned along side walls and end walls of the building. Rafters 16 overlie the tops of the columns and are supported by the columns. Rafters 16 span the width of the building, creating a series of open spaces between rafters 16, the open spaces being commonly referred to as "bays" 18 in the construction arts, the bays representing distances between respective ones of the rafters. Each rafter has an upper surface 16A, and opposing first 16B and second 16C ends.

According to the embodiments illustrated in FIGS. 1-4, eaves 20, expressing "C"-shaped cross-sections, are positioned at the down-slope ends of the rafters 16. Lengths of the eaves extend along the length of the building, above the outer wall of the building. The eaves provide lateral support to the skeletal structure of the building between respective ones of the columns 14, at the outer building wall. A given eave extends between the first ends 16B of respective ones of the rafters.

Figure 4:
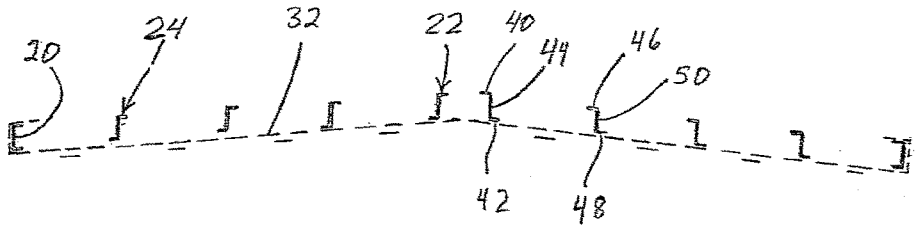
FIG. 4 is a diagrammatic end view of a roof structure of a metal building, showing longitudinal band spacing with respect to the eaves, the ridges, and the intermediate purlins.

Ridge members 22, expressing "Z"-shaped cross-sections as illustrated in FIG. 4, have lengths which overlie, and are attached to, the upper surfaces of rafters 16. The ridge members are positioned at the up-slope ends of the rafters, and run the length of the building parallel to the eaves, typically above the central portion of the building. The ridge members provide lateral support to the skeletal structure of the building between respective ones of rafters 16, typically at an internal portion of the building, away from the building side walls in the illustrated embodiments. A given ridge member extends between the second ends 16C of the respective ones of the rafters. Where the roof has a single pitch direction, the ridge can be positioned proximate one of the outer walls of the building.

The ridge members and the eave members overlie, extend transverse to, and are attached to, the upper surfaces of the respective rafters 16, and are spaced from each other by distances which generally correspond to the lengths of the respective rafters between ends 16B and 16C.

Intermediate purlins 24 express "Z"-shaped cross-sections. The intermediate purlins overlie, extend transverse to, and are attached to, upper surfaces 16A of the respective rafters. Purlins 24 are spaced from each other along the lengths of the rafters. The purlins extend parallel to each other and parallel to any ridges and eaves and, overall, span the length of the bay, whereby the purlins are displaced from each other and from any ridges and eaves along the spaces between the respective eave and the ridge.

Figure 2:
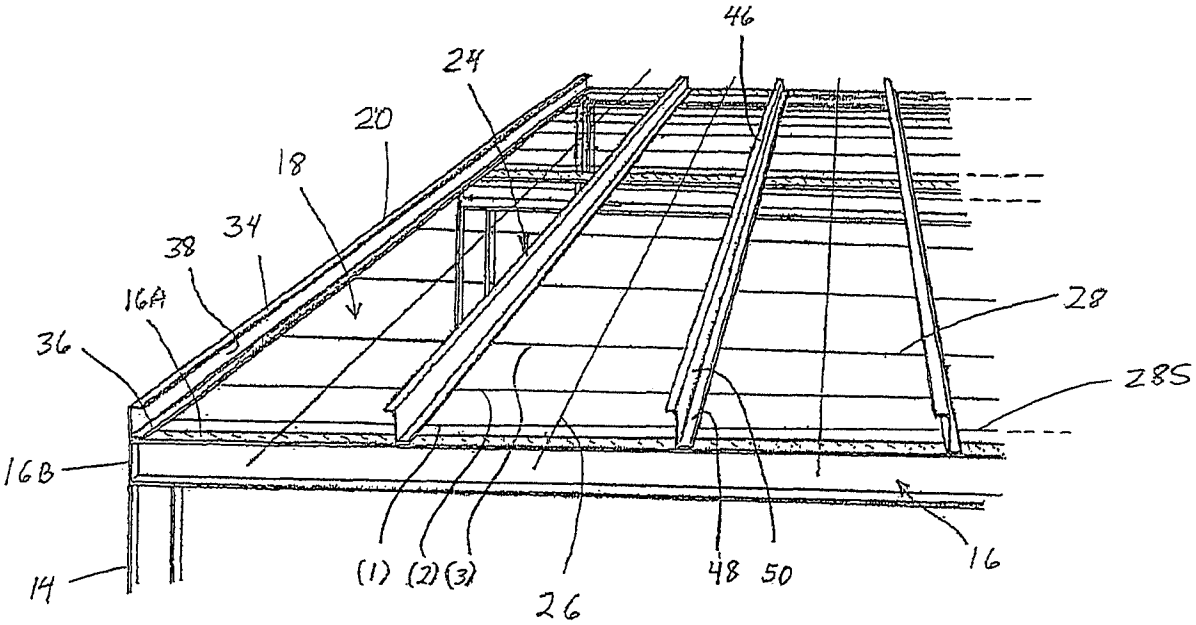
FIG. 2 is a perspective view, from above the roof, of part of a bay of a metal building, showing columns, rafters, purlins, an eave, and a grid-work of crossing bands.

As shown in FIG. 2, the fall protection support system, namely the suspension system, of this invention includes a supporting grid-work formed by crossing elongate steel bands, including longitudinal support bands 26 and lateral support bands 28. Support bands 26, 28 of the grid-work are supported by various ones of the building structural members, as described herein, and the collective grid-work generally defines an imaginary plane, extending into the sheet of the drawing illustrated in FIG. 4. Such imaginary plane extends parallel to a set of imaginary straight lines, spaced from each other and extending between the lower surfaces of the eaves 20, the ridge 22, and intermediate purlins 24, and further extending parallel to imaginary straight lines which connect the upper surfaces of the rafters.

Figure 3:
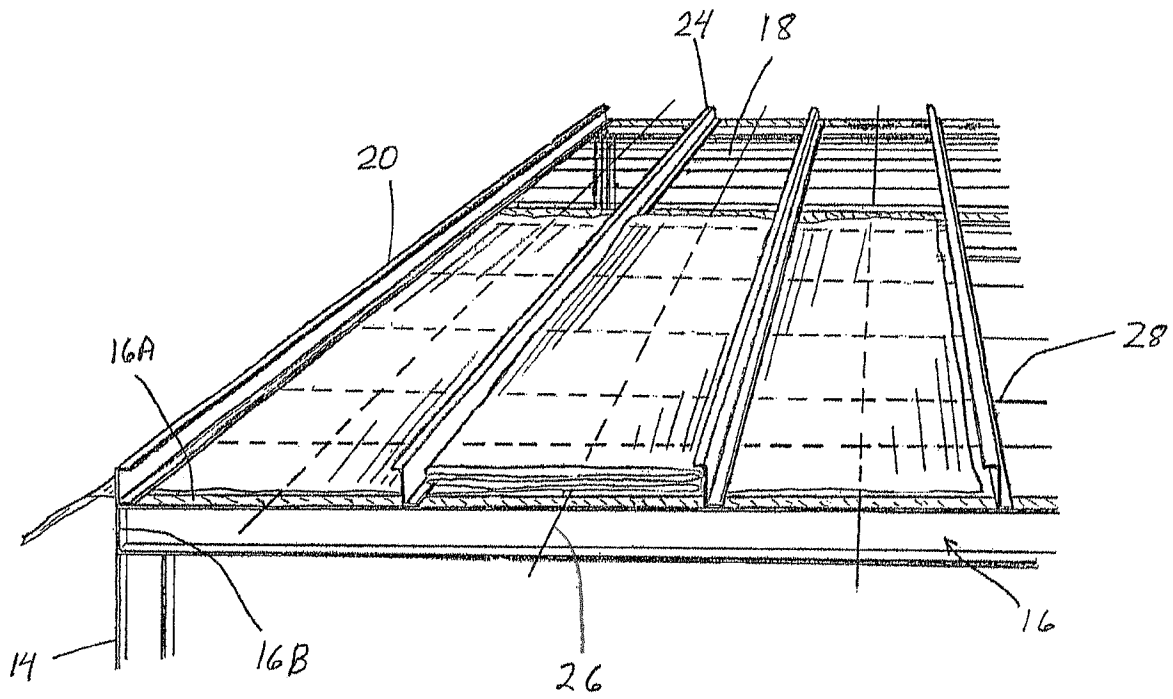
FIG. 3 is a perspective view as in FIG. 2 showing a suspension fabric partially extended over the band grid-work and under the eave and under the purlins, in a single bay.

Support bands 26, 28 support a high strength fabric 32, the fabric being shown partially unfolded in FIG. 3 and, in FIG. 4, the fabric is suggested by the dashed line under the eave, ridge, and intermediate purlins, and above longitudinal bands 26, bands 26 being shown in FIG. 4 in end view. Fabric 32 in the illustrated embodiments also serves as a vapor barrier for the insulation system which is ultimately installed at the roof of the building.

Starting with the structural skeleton of the building as illustrated in FIG. 1, a fall protection system of the invention is installed generally as follows. Longitudinal metal bands 26 are extended from the upper surface of a first one of the rafters to the upper surface of a second one of the rafters at angles which are typically, but not necessarily, perpendicular to the respective rafters. The number of longitudinal bands 26 depends to some degree on the distance between the respective ones of the intermediate purlins 24. In the invention, typically only a single longitudinal band 26 is used between each pair of next-adjacent purlins 24. However, in certain systems, which can be engineered based on the technology disclosed herein, two or more longitudinal bands may be used where such additional band use may be cost-effective and/or when use of such additional band may be needed in order to satisfy the respective governmental standard. Of course, the greater the number of bands used, the greater the cost of the band system. Accordingly, the user is motivated to have the system engineered so as to use as few of such longitudinal bands as possible while meeting the required safety standards.

A length of a given longitudinal band 26 extends across a given bay and is extended across the upper surface of each rafter overlain by the respective band, and is attached to the upper surfaces, or other surfaces, of the respective rafters. Where the longitudinal band 26 extends across multiple bays, the longitudinal band is secured, for restrained longitudinal movement, to the upper surfaces of those rafters which are most remote from one another. Optionally, but not necessarily, the longitudinal band may be secured to one or more intermediate rafters.

Longitudinal bands 26 are fastened to the rafters or rake channels (not shown) which correspond with the end portions of the bands by conventional attachment means such as by self-drilling screws. Longitudinal bands 26 are pulled tight between the rafters so as to, in part, and at this stage of installation, begin to define the afore-mentioned band grid, and the imaginary plane of support provided by the band grid, immediately under the intermediate purlins. Band attachment tools, known in the art, may be used in attaching the bands, either temporarily or permanently, to the rafters or rake channels, thus to instill a suitable, conventionally known, level of tension in bands 26 as the bands are being installed.

Each eave has a top flange 34, a bottom flange 36, and an upstanding web 38 extending between the top and bottom flanges, and connecting the top flange to the bottom flange. The top and bottom flanges are arranged such that the profile of the eave defines a generally "C"-shaped structure, perhaps best seen in FIG. 5.

While the eave profiles shown define generally perpendicular turns between the flanges 34 and 36, and upstanding web 38, actual eave profiles typically define a modest acute angle (not shown) between the bottom flange and the upstanding web and a corresponding modest obtuse angle (not shown) between the top flange and the upstanding web. Such acute and obtuse angles adapt the eave to the specific slope of the roof for which the eaves are designed, while providing that the upstanding web conform to the vertical orientation of the respective side wall of the building.

Correspondingly, each ridge has a top flange 40, a bottom flange 42, and an upstanding web 44 extending between the top and bottom flanges, and connecting the top flange to the bottom flange. The top and bottom flanges are arranged such that the profile of the ridge defines a "Z"-shaped structure, as illustrated in FIG. 4.

Similarly, each intermediate purlin has a top flange 46, a bottom flange 48, and an upstanding web 50 extending between the top and bottom flanges, and connecting the top flange to the bottom flange. The top and bottom flanges are arranged such that the profile of the respective purlin defines a "Z"-shaped structure, illustrated in FIGS. 4 and 6.

Lateral bands 28 are installed after the longitudinal bands 26 are in place. Lateral bands 28 extend transverse to, typically perpendicular to, the longitudinal bands. Lateral bands 28 generally underlie and support longitudinal bands 26. Lateral bands 28 may be first attached to the respective ridge 22. Bands 28 may be attached to any suitable surface of the ridge which enables the band to pass, from the location of attachment, under and in tensioned contact with, the bottom flange of the ridge. For example, a lateral band can be attached to the bottom surface of the bottom flange of the ridge, with intervening fabric 32, and extend from there toward the eave.

The lateral bands are extended, from the bottom surface of the bottom flange of the ridge toward the respective eave, passing under some or all of the longitudinal bands, and pulled tight to minimize sag in both the lateral bands and the respective overlying longitudinal bands. A given lateral band may optionally pass over one or more of the longitudinal bands. However, at least one lateral band passes under each longitudinal band. The so-tightened lateral bands are in general contact, again with intervening fabric, with the bottom surface of the bottom flange of the respective eave. With the so-tightened lateral bands in contact with the bottom surface of the bottom flange of the respective eave, the lateral bands are fastened to the eave so as to maintain the tension in the lateral bands, thus to lift the lateral bands toward the bottom flanges of the overlying intermediate purlins.

The number of lateral bands 28 to be used between a respective pair of next-adjacent rafters, and the spacing between the lateral bands, varies with the distance between the rafters. Typically, the lateral bands are nominally 36 inches to 40 inches apart, optionally 48 inches apart in some cases, and up to 60 inches apart in other instances.

In this invention, a given uniform spacing of lateral bands 28 is typically maintained constant between first and second ones of the rafters, plus an additional band, referred to herein as a "safety band", is installed next adjacent each side of each rafter so long as the respective safety band is overlying a portion of the so-suspended fabric. Thus, at the end of the building, a safety band is installed over the end bay adjacent the rafter, but no safety band is installed on the opposite side of the rafter, which is beyond any bay.

As a result of extensive testing, the inventors have discovered that the top edges of the rafter flanges may be sharp enough to cut the suspension fabric when a 400 pound test bag is dropped from e.g. 50.5 inches onto conventional fall protection systems, where the bag is dropped such that the edge of the bag is close to the rafter. In a conventional design of the band grid-work, not of this invention, the lateral band closest to the rafter, namely the next adjacent lateral band, is specified to be spaced 6 inches from the rafter, and to extend parallel to the rafter.

The inventors herein have discovered that, when a 400 pound test bag is dropped onto such conventional fall protection system where the band is so spaced 6 inches from the rafter, with the edge of the bag close to the edge of the rafter, only a minor portion of the mass of the bag is between the rafter and the lateral band closest to the rafter. Correspondingly, that closest band is between the rafter and the majority of the mass of the bag. With that closest band thus positioned between the rafter and the majority of the mass of the bag, the force of the fall exerts both a downward force and a substantial transverse force on that closest band. The band responds to the downward force by stretching/elongating and the like, as well as by transferring some of that force to other members of the fall protection system, including to members of the building roof structure.

For example, where the respective band is anchored to an adjacent purlin by an e.g. Tek screw, as in known art, the pulling force on the band may create a longitudinal, optionally transverse, tear in the band as the band material is pulled longitudinally relative to the stationary screw which extends through the band and into the purlin. Thus, in addition to elongating by plastic deformation of the band material, the band may also tear at an anchoring screw, thereby further elongating the length of band material which is between the respective purlins.

So, even though the band is stressed/tight when impacted by a falling test bag in the known art, the ultimate length of band material between the anchoring purlins at the drop site increases when a test bag impacts the fall protection system. Once the band length increases, the band is no longer tight, no longer extends in a straight line across the space between respective ones of the purlins. With the band no longer tight, the band is readily pushed in a transverse direction, toward the rafter, and typically under the top flange of the rafter. With the band moved out of the way and under the top flange of the rafter, the stress on the fabric becomes a stress applied at the near edge of the top flange of the rafter as the fabric is being pulled downwardly across that near edge of the rafter. Under that stress, and at such angle, the top flange of the rafter is effective to cut through the suspension fabric, whereby the fabric is cut/penetrated by the top edge of the rafter. Such penetration of the fabric is considered a failure of the fall protection system, since the human which the fall protection is intended to protect, could well fall through such hole which has been cut in the fabric, with result that the person intended to be protected by the fall protection system, is indeed not protected by the system.

Figure 8:
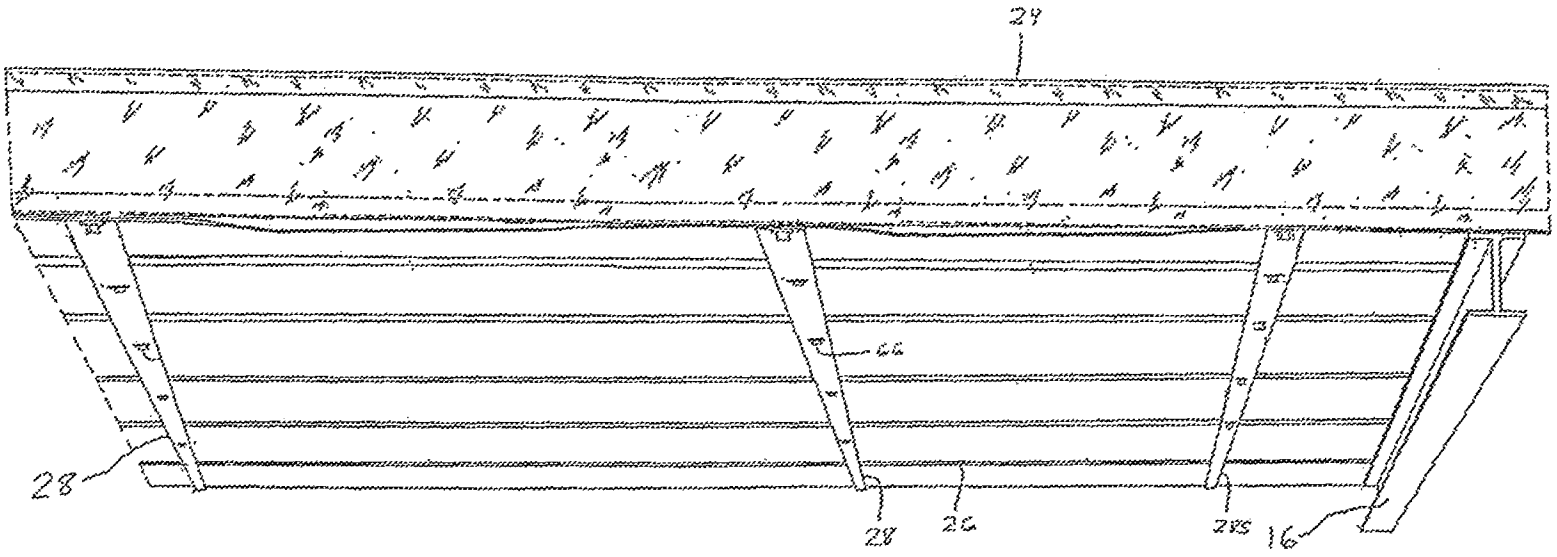
FIG. 8 is a perspective view as in FIG. 7, showing a third one of the lateral bands, thus showing the three different spacings of respective ones of the lateral bands.

Referring to FIG. 8, the inventors herein have discovered that positioning of that closest band, herein called the "safety band" 28S, affects the ability of the fabric to not be cut by the edge of the rafter flange; that the distance between the rafter and the safety band is a determining factor in whether the fabric is cut by the rafter when force is exerted on the fabric by the falling 30-inch wide bag. Position the safety band too close to the rafter and the bag pushes the band toward the rafter, potentially under the top flange of the rafter. With the fabric so exposed to the top edge of the top flange at such downward deflection angle of the fabric, and the fabric is susceptible to being cut by the rafter.

By contrast, position the safety band too far away from the rafter and, when the bag is dropped close to the rafter, the band is between the rafter and a minority portion of the mass of the falling bag; the majority of the mass of the falling bag being between the safety band and the rafter. Given such positioning, as the mass falls, much of the transverse portion of the force imposed on the fall protection system is transferred to the safety band, potentially causing the safety band to move away from the respective rafter; whereby a substantial fraction of the force of the fall is imposed on the suspension fabric between the safety band and the top flange of the rafter. Again, the suspension fabric is driven downwardly with force against the edge of the top flange of the rafter with the fabric being pulled downwardly across the near edge of the rafter; with potential that the suspension fabric gets cut by the top flange of the rafter.

In resolving the above failures, the invention herein specifies that the safety band, namely that lateral band which is closest to the rafter, is located no less than 12 inches, and no more than 23 inches, from the respective edge of the top flange of the respective rafter. The purpose of such spacing is to enable the safety band to absorb more of the downward force/impact of the falling bag adjacent the rafter, with limited or no translational movement of the band. If the safety band is less than 12 inches from the top flange of the rafter, the falling bag pushes the safety band so far toward the respective rafter that the suspension fabric may be directly exposed to the cutting edge of the rafter. If the safety band is more than 23 inches from the top flange of the respective rafter, the falling bag pushes the safety band away from the rafter, with the result that there is no banding between the central point of impact and the cutting edge of the rafter. And again, the fabric adjacent the rafter is pulled violently down onto the edge of the top flange of the rafter with substantial potential that the suspension fabric will be cut by the rafter.

Choosing to not be bound by theory, the inventors herein contemplate that the critical factor is to have the band under a central portion of the bag when the bag is positioned, for a drop test, such that the edge of the bag is close to the rafter at impact, such that the translational movement of the band is limited. Namely, if the safety band is generally under the central portion of the bag, the force of the impact is generally transferred to a downward movement of the band whereby downward movement of the fabric and the down angle of the fabric, adjacent the rafter is lessened such that the fabric is not cut by the rafter. If the central point of the impact is beyond the band, such that the safety band is between the central point of the impact and the rafter, then any translational movement of the bag moves the bag away from the rafter which, again, limits the force on the fabric, thus the downward movement of the fabric, at the rafter, as well as the downward angle at which the fabric interacts with the rafter, enough that the fabric is not cut by the rafter.

When using the OSHA test requirements as the standard for determining the distance between the rafter and the safety band, the test-specified diameter of the bag becomes a determining factor. Where, as in the OSHA requirements, the bag diameter is 30 inches, plus or minus two inches, a distance of about 16 inches, optionally about 14 inches to about 18 inches, works well for the distance between the edge of the rafter and the middle of the safety band. In some instances distances as small as 12 inches, and greater than 18 inches, and up to about 23 inches, from the rafter can be satisfactory, for the safety band.

Given the addition of the safety band, given the overall equi-distant spacing of the remaining bands, from each other and from the rafters, the spacing of the lateral bands can be expressed as follows:

a. The lateral bands, other than the safety bands, are all equally spaced from each other and from the rafters;
b. The safety band is an additional band, not affecting the number, or spacing, of the other bands;
c. The safety bands are spaced from the rafters by first distances different from the second distances between other lateral bands which is different from the distances between the other lateral bands and the rafter systems and;
d. The distance between the safety band (1) and the next adjacent lateral band (2) approximates the distance between the next adjacent band (2) and the next adjacent band (3) which is away from the safety band, less the distance between the safety band (1) and corresponding rafters.

The determination of passing or failing the government-defined drop test is to answer the question of whether the falling object proceeds through the fabric, known as a test failure, or is successfully held and supported by the fabric, which is a successful, passing of the test.

A variety of banding stock can be used for bands 26 and 28. A typical banding stock is a hot-dip zinc/aluminum alloy-coated Grade 80 structural steel, 0.023 inch thick. Such Grade 80 banding is sometimes referred to in the industry as "full hard". Such steel banding, as used, is typically about 1 inch wide and continuous length. Such traditional "full hard" steel banding is available from Steelscape, A BlueScope Steel Company, Kalama, Wash. as ZINCALUME® Steel Grade 80 (Class 1).

Representative properties of such Grade 80 (Class 1) banding, 0.023 inch thick, from Steelscape are as follows:

Yield strength—100.1 ksi average, 93.9-104.1 ksi range

Tensile strength—102.2 ksi average, 95.4-105.3 ksi range

Elongation in 2 inch sample—10% average, 9.6-10.3% range

Hardness, Rockwell B Scale—93.4 average, 92-95 range

"Ksi" means "thousands of pounds per square inch".

Each lateral band is attached by a Tek screw to the bottom flange of each intermediate purlin, whereby a substantial fraction of the force of a worker falling, or the force of a drop test bag, is transferred through the respective lateral bands to the next adjacent purlins and to any adjacent rafter.

Where the force of a drop/impact/fall is applied at the lateral band which is next-adjacent a rafter, that force may be transferred by a single one of such lateral bands, in addition to the affected longitudinal band, to the building structural roof members.

Figure 5:
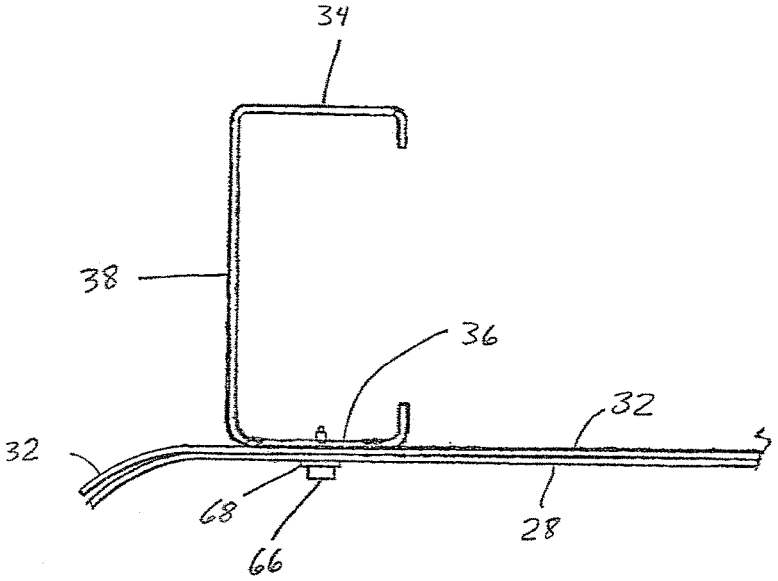
FIG. 5 is an edge view showing a lateral band fastened, attached, to the bottom flange of the eave.
Figure 6:
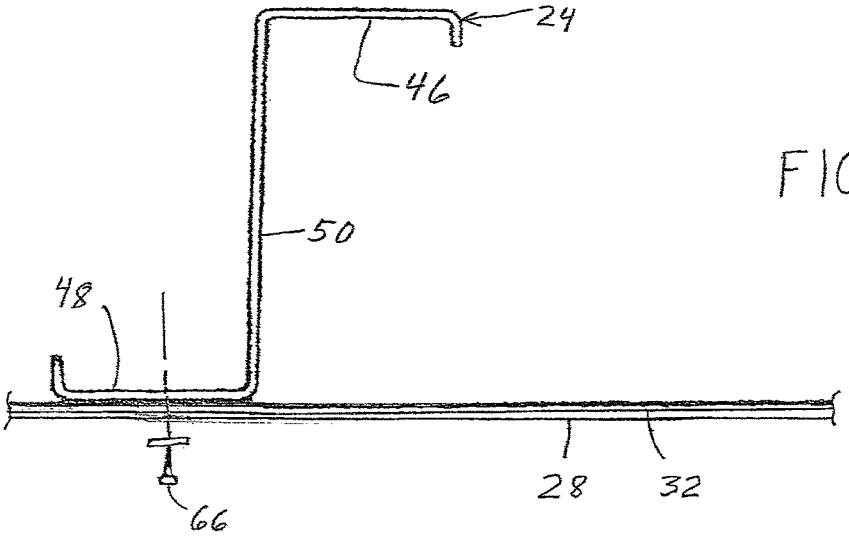
FIG. 6 is a cross-section of an intermediate purlin, and a Tek screw, with washer, positioned to extend the screw through the fabric and into the purlin bottom flange.

FIG. 5 shows the attachment of a lateral band to an eave 20 using a standard Tek screw. FIG. 6 shows the impending attachment of the lateral band to an intermediate purlin using a standard Tek screw.

Figure 7:
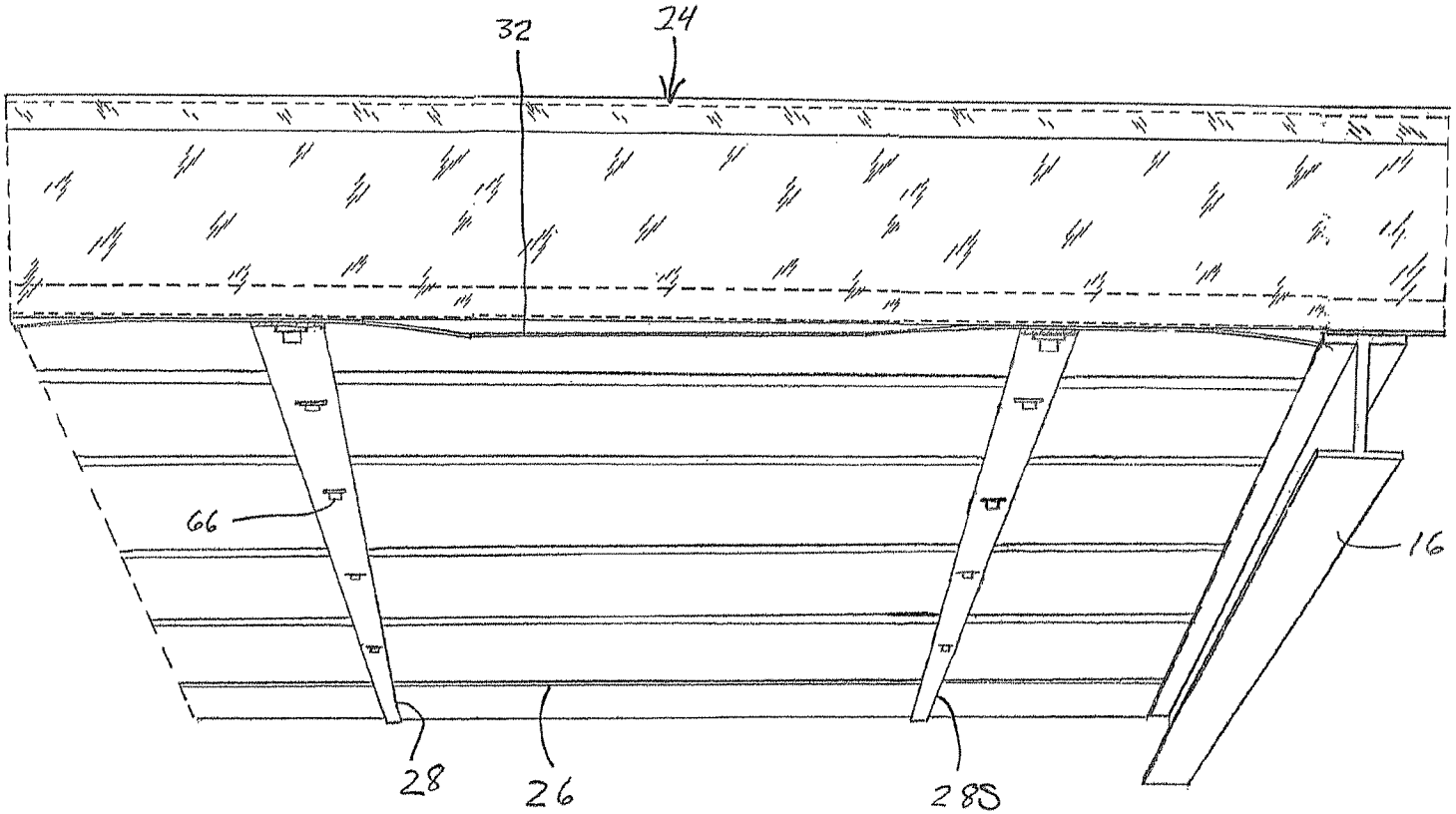
FIG. 7 is a perspective view from below a fall protection system of the invention, showing a purlin mounted on one of the rafters, also showing the lateral bands and the longitudinal bands collectively supporting the suspension fabric across a bay.

FIG. 7 illustrates that longitudinal bands 26 are supported by lateral bands 28, in that each longitudinal band is underlain by at least one of the tightened lateral bands. Referring again to FIGS. 2 and 3, it is seen again that the longitudinal bands are secured against longitudinal movement only at rafters 16.

Another banding stock suitable for use for at least some of the lateral bands 28, and which is especially useful for the safety bands, is relatively softer and more yielding than the Grade 80 banding, though the physical dimensions of such bands are the same, at 1 inch width, and 0.023 inch thickness, whether the Grade 80 banding stock, or the Grade 50 banding stock, is used. Representative properties of such Grade 50 (Class 1) banding, 0.023 inch thick, from Steelscape, are as follows:

Yield strength, average—58.1 ksi, 51.3-64.0 ksi range

Tensile strength, average—72.0 ksi, 65.5-78.7 ksi range

Elongation in 2 inch sample—30.8% average, 22.5-36.6% range

Hardness, Rockwell B Scale—72.3 average, 64-79 range

An overall acceptable range of properties for the 0.023 inch thick banding, 1 inch wide, is as follows:

Yield strength—50 ksi-105 ksi,

Tensile strength—50 ksi-105 ksi,

Elongation in 2 inch sample—10%-40%, and

Hardness, Rockwell B Scale—64-95.

In some embodiments, the Grade 80 banding is used for all of the lateral bands and all of the longitudinal bands.

In some embodiments, the relatively softer Grade 50 banding is used for the safety bands 28S while the relatively harder Grade 80 banding is used for the longitudinal banding and all of the other (non-safety band) lateral bands.

In other embodiments, the Grade 50 banding is used for all of the lateral bands, including the safety band, and Grade 80 banding is used for all the longitudinal bands In still other embodiments, the Grade 50 banding is used for all of the lateral bands, including the safety bands, and for all of the longitudinal bands.

Yield, tensile and elongation properties are determined using an Instron Tensile Tester according to ASTM A370-12a. Briefly, a two-inches-long section of a dog-bone shaped sample is placed in the jaws of the test machine, and stretched by the machine until the sample breaks. Yield and ultimate tensile are recorded by the testing machine. Elongation is measured manually according to the test procedure after the sample breaks.

In light of the benefits provided by better positioning of the safety band, the invention provides novel control of the angle and magnitude of the stress exerted on the fabric at the distal edge of the top flange of the rafter.

In the invention, a safety band is thus located adjacent each side of each rafter, where such band is to be overlaid by the suspension fabric to thus support a falling object.

The safety band is an additional band, in additional to the number of lateral bands which would otherwise be used across a given bay, between the first and second rafters. Accordingly, where the bay spacing normally calls for a lateral band e.g. 36-40 inches from the first rafter, that lateral band is installed at the specified distance, and an additional band is installed, as the safety band, at a distance of 12-23 inches, optionally 14-18 inches, optionally 16 inches from the rafter.

Thus, where the bay width, between rafters is 25 feet (300 inches), with a maximum distance between bands being 40 inches, the theoretical number of spaces between bands is 300/40=7.5 spaces, thus 6.5 bands. Accordingly, 7 lateral bands are indicated across the bay, without considering the safety bands. The 7 "typical" lateral bands are spaced 37.5 inches apart. In addition, the 2 safety bands, one on each side of the bay, are next adjacent the respective rafters. Accordingly, the two bands closest to a given rafter are 16 (the safety band) and 37.5 inches from the rafter. Thus, the distance from the rafter to the safety band is 16 inches, the distance from the safety band to the next adjacent band is 21.5 inches, and the distance from the next adjacent lateral band to the third lateral band from the rafter, is 37.5 inches.

Banding used in the invention is distinguished from steel bar stock in that steel bar stock is stiff and rigid. By contrast, the banding used in the invention is thin and flexible such that the banding is typically shipped to the user in rolls. When the banding stock is cut to the e.g. specified 1-inch width, and the resulting bands are loosely draped over rafters spaced e.g. 25 feet apart, mid-sections of the bands readily drape downwardly by multiple feet from the elevations of the rafters. Further, such banding is completely incapable of supporting itself or the overlying suspension fabric, across the length and width of a typical bay, until substantial tensile force, which can be manually applied using hand tools, is applied to the banding.

Certain fabrics are known in the art for use as suspension fabrics in roof insulation systems, and such fabrics may be acceptable in the fall protection systems of the invention, provided that the bands used in the band grid-work of the invention are sufficiently close together. An exemplary fabric, which the inventors have tested and found satisfactory for use with the band grid-work disclosed herein is available as Type 1070 Vapor Retarder fabric from Intertape Polymer Group, Bradenton, Fla. The Type 1070 fabric is a woven HDPE scrim having the following characteristics as specified by the fabric supplier:

Nominal thickness—9 mils (0.23 mm)

Nominal weight—4.3 oz/yd$^2$ (149 g/m$^2$)

Grab Tensile—Warp 136 lb (605 N)/Weft 126 lb (559 N)

Strip Tensile—Warp 100 lb/in (877)/Weft 90 lb/in (799)

Tongue Tear—Warp 50 lb (222N)/Weft 45 lb (200 N)

Mullen Burst—245 psi (1690 kPa)

Moisture vapor transmission—0.02 perms.

A typical bay 18 is about 25 feet wide, between pairs of next-adjacent rafters. Within a given bay, lateral bands 28 extend parallel to each other, parallel to the respective rafters which define the bay, and are generally spaced apart by about 36 inches to 40 inches. Thus, a desired spacing between lateral bands 28 is 36-40 inches; and up to 48 inches, optionally up to 60 inches, is accepted where the increase can reduce the number of bands without compromising the ability of the fall protection system to successfully catch and hold either a falling worker or a falling test bag.

A leading edge of fabric 32 can be placed inside the eave. Such leading edge of the fabric enters the eave above bottom flange 36, passes across the top of the bottom flange to web 38, passes along the inside surface of web 38 and up to upper flange 34 and thence toward the ridge to the eave opening which faces the ridge. By traversing such path inside the cavity defined inside the eave, the fabric can substantially encase the edge of any insulation which is to be installed on top of the fabric in the space between the eave and the next-adjacent purlin.

In the alternative, the edge of the fabric, at the eave, can be trapped between the lateral banding and the lower surface of the bottom flange of the eave as suggested in FIGS. 3 and 5.

If/When a falling/dropping impact force arrives on the suspension fabric, the force received by the suspension fabric has a first directional force component and a second velocity/shock/suddenness component. The force component of the impact is resisted by, absorbed by, the deflection characteristics of the materials in the fall protection system. The velocity/shock/suddenness component of the impact addresses the rate at which the respective materials can deflect as the force of the impact is applied to the respective building elements.

Where a given lateral band 28 is one of the closest lateral bands to the point where the impact force is received, a first portion of that force, which is received at the fall protection system, is transferred, as first tensile forces, into the respective lateral band and is absorbed, dissipated, at least in part, by tensile elongation of the respective lateral band.

A second portion of that received force is transferred, by the lateral band to the next-adjacent purlins which are closest to the location of the impact.

A third portion of that force is received into the respective closest longitudinal band, or bands, and is absorbed, dissipated, at least in part, by tensile elongation of the respective longitudinal band or bands.

A fourth portion of that received force is received by the respective longitudinal band or bands, and transferred by the longitudinal bands, to the respective rafters 16 or any rake channel.

A fifth portion of that received force is distributed about the respective affected area of the suspension fabric. While choosing to not be bound by theory, the inventors herein contemplate that the fabric absorbs both a portion of the directional component of the force of the impact and a velocity/shock/suddenness component of the force of the impact.

Turning again to the responses of the bands, the tensile forces so imposed on the respective longitudinal band or bands and the respective lateral band or bands are distributed along the full lengths of the respective longitudinal bands and along that portion of the respective lateral band or bands which is/are between the two purlins to which that portion of the respective lateral band is mounted. Thus, the elongation properties of both the longitudinal bands and the lateral bands are utilized in transferring portions of the impact force to the roof structural elements, namely one or more intermediate purlins, and optionally to ridges or eaves, and to the rafters.

FIG. 7 further shows, in its typical configuration of the fall protection system of the invention, that lateral bands 28 can, and commonly are, attached to each purlin in a conventional manner, namely by screwing a Tek screw 66, with accompanying washer, through a hole in the lateral band, thence through the suspension fabric, and thence through the lower flange of the respective purlin. The suspension fabric is thus trapped between the lower flange of the purlin and the respective washer/screw combination, which tightly clamps the suspension fabric to the lower surface of the lower flange of the purlin.

Method

Installation of a fall protection system of the invention begins after the columns, rafters, ridges, eaves, and intermediate purlins are in place about at least a given bay. Typically, installation of the fall protection system begins after erection/emplacement of all of the columns, rafters, ridges, eaves, and purlins.

Installation of the fall protection system begins by installing longitudinal bands 26. A given longitudinal band is installed by unwinding band material from a roll and extending the band material over the tops of the respective rafters and across a given bay or bays. At least one longitudinal band is extended, between each next-adjacent pair of purlins to at least the next rafter, and is cut to length. The longitudinal bands are manually stretched tight with hand tools, and the so-tightened bands are fastened to the respective rafters and/or rake channels with Tek screws. As illustrated in the drawings, the longitudinal bands typically extend perpendicular to the rafters. The so-partially-installed, tightened, longitudinal bands extend from rafter to rafter at generally the height of the tops of the rafters, but some nominal amount of sag of the longitudinal bands exists between the rafters at this stage of installation.

Typically, the purlins are spaced no more than 5 feet apart. In this invention, typically a single band is installed between each pair of next-adjacent purlins so long as the purlin spacing is no more than the typical maximum of 5 feet. In some instances, an additional longitudinal band 26 may be used in one or more of the spaces between the purlins.

Once the longitudinal bands 26 have been emplaced and tightened, banding for lateral bands 28 is unrolled under the longitudinal bands, and one end of the banding is secured to the respective ridge or purlin, or to an opposing eave. The lateral banding material is extended to the eave of the respective bay, optionally threaded above one or more of the longitudinal bands along the way, and then tightened sufficiently to raise both the lateral band and the overlying longitudinal bands into close proximity with the intermediate purlins. This process is repeated along the width of the bay, e.g. between the rafters, until the desired number of lateral bands has been emplaced across the width of the bay, including the addition of the safety bands adjacent each side of each rafter, which side is being protected by the suspension fabric.

With the band grid system thus temporarily in place, a zigzag-folded roll of the suspension fabric is elevated to the height of the rafters, typically adjacent a rafter at an end of the building or bay. The fabric is then unrolled on top of the band grid in one of the spaces between next-adjacent ones of the purlins such that one end of the fabric faces the eave and the opposing end of the fabric faces the ridge. The ends of the fabric are then pulled, individually, toward the eave and the ridge, working the leading ends of the fabric under the intervening intermediate purlins and above the band grid. The initial phase of the process of so-extending the fabric is illustrated in FIG. 3.

With the fabric having been generally extended the full length and width of the bay over which the fabric is to be suspended as a single layer, namely over the band grid and under the intermediate purlins, the lateral bands are then attached to the intermediate purlins, one self-drilling Tek screw through each lateral band and the fabric, at each purlin, typically beginning at the ridge and working toward the eave. As a such Tek screw/washer is driven tight against the bottom surface of the fabric, the fabric is correspondingly driven tight against the bottom surface of the lower flange of the purlin. The fabric is thus tightly trapped between the washer and the lower flange of the respective purtin. Screws 66 are driven through each lateral band 28 at each purlin, fastening the lateral bands directly to the purlins as illustrated in FIG. 7.

Once the attachments to the intermediate purlins have been completed, the temporary attachments of the lateral bands and the safety band to the eave are released, and the lateral bands are permanently attached to the eave, e.g. using screws 66 driven through the lateral bands, e.g. as illustrated in FIG. 5.

Sides of the fabric are then cut around the purlins at each rafter, as known in the art, and edges of the fabric are secured to the top surfaces of the rafters such as by adhesive, also as known in the art.

With both the longitudinal and lateral bands, including safety bands 28S, so secured to the roof structure; with the fabric so secured to the ridge and eave by the lateral bands and secured to the rafters by e.g. adhesive, installation of the fall protection system of the invention is complete and ready to protect workers who subsequently install other elements of the building while working at the roof elevation; such elements as the roof insulation and the roof panels.

Suspension fabric 32, which in the preferred embodiment consists of a vapor barrier material, is trimmed to size before installation. The suspension fabric is installed one bay 18 at a time and, in the case of large buildings or buildings with high gables, fabric 32 for each half of the bay may be divided at ridge 22 and may be installed separately.

The suspension fabric has been cut, prior to installation, to a size having a dimension a few inches longer, at each side and each end, than the dimensions of the bay to be overlaid, and is Z-folded for easy spreading above the band grid. For this purpose a zigzag type fold, as shown in FIG. 3, is easiest to work with, although other rolling or folding arrangements can also be used and are within the scope of the invention.

The fall protection systems of the invention are designed to be of sufficient strength to catch and support a worker's weight, generally between 250 and 400 pounds. The system is tested by dropping a 400 lb. weight with the center of gravity of the weight, before the weight is dropped, being 42 inches above a worker's walking height, thus 42 inches plus the height of the purlins, namely about 50.5 inches above the fabric. To pass the test, the system must stop the falling weight at any point in the bay which is so protected. In one test specified by OSHA, 400 lb. of washed gravel or sand is placed into a reinforced bag that can tolerate being dropped repeatedly. The test bag is 30 inches in diameter. The 400 pound bag is hoisted above the fall protection system to a height of 42 inches above the plane of the intermediate purlins, measuring from the center of the so-filled bag. A cord supporting the weight of the bag is then released, allowing the weight to free fall in one concentrated load. The weight can be dropped onto any part of the fall protection system to test different areas.

Although the invention has been described with respect to various embodiments, it should be realized this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A fall protection system in a building roof structure, said building roof structure including structural roof elements which include at least first and second rafters, a space between said first and second rafters defining a first distance between said first and second rafters, each said rafter having a length, a top, and opposing first and second ends, said roof structure further comprising an eave, having a length, and extending between the first ends of said first and second rafters, a ridge, having a length, and extending between the second ends of said first and second rafters, and a second distance between said eave and said ridge, said eave and said ridge being disposed on, and extending transverse to, the tops of said first and second rafters, and a plurality of intermediate purlins extending between said first and second rafters and spaced from each other between said eave and said ridge, said intermediate purlins being disposed on, and extending transverse to, the tops of said first and second rafters, said fall protection system comprising:

(a) a first set of longitudinal support bands extending from said first rafter to said second rafter and being connected to said building structural roof elements, said first set of longitudinal support bands being spaced along the lengths of said first and second rafters;

(b) a second set of lateral support bands extending from said eave toward said ridge and under said intermediate purlins, said lateral bands of said second set of support bands having first and second end portions which are spaced along the lengths of said eave and said ridge; and (c) a suspension fabric overlying, and being supported by, said first and second sets of support bands, and being attached to said building structural roof elements, a first band of said second set of lateral support bands, next adjacent said first rafter, comprising a safety band, spaced from said first rafter by a distance of 12 inches to 23 inches.

2. A fall protection system as in claim 1 wherein said first band of said second set of lateral support bands uses a first banding material which has a first yield strength, and at least a second one of the remaining ones of said bands in at least one of said first and second sets of support bands, use a second banding material which has a second yield strength different from the first yield strength.

3. A fall protection system as in claim 1 wherein said lateral bands, including said first band, use a first banding material which has a first yield strength, and said longitudinal bands use a second banding material which has a second yield strength greater than the first yield strength.

4. A fall protection system as in claim 1 wherein all of said lateral bands, including said first band, use a banding material which has yield strength of 50 ksi to 64 ksi,
tensile strength of 50 ksi to 78 ksi,
elongation of 22% to 37%, and
Rockwell B hardness of 64-79.

5. A fall protection system as in claim 1 wherein said first band is spaced from said first rafter by a distance of about 14 inches to about 18 inches.

6. A fall protection system as in claim 1 wherein said first band is spaced from said first rafter by a distance of about 16 inches.

7. A fall protection system in a building roof structure, for protecting workers involved in installation of said roof structure, said building roof structure including structural roof elements which include at least first and second rafters, a space between said first and second rafters defining a first distance between said first and second rafters, each said rafter having a length, a top, and opposing first and second ends, said roof structure further comprising an eave, having a length, and extending between the first ends of said first and second rafters, a ridge, having a length, and extending between the second ends of said first and second rafters, and a second distance between said eave and said ridge, said eave and said ridge being disposed on, extending transverse to, and being connected to, the tops of said first and second rafters, and a plurality of intermediate purlins extending between said first and second rafters and spaced from each other between said eave and said ridge, said intermediate purlins being disposed on, and extending transverse to, the tops of said first and second rafters, said fall protection system comprising:

(a) a first set of longitudinal support bands extending from said first rafter to said second rafter and being connected to said building structural roof elements, said first set of longitudinal support bands being spaced along the lengths of said first and second rafters;
(b) a second set of lateral support bands extending from said eave toward said ridge and under said intermediate purlins, said bands of said second set of support bands having first and second end portions which are spaced along the lengths of said eave and said ridge; and
(c) a suspension fabric overlying, and being supported by, said first and second sets of support bands, and being attached to said building structural roof elements, said first and second sets of support bands collectively defining a grid-work of crossing bands,
at least a first one of said bands in at last one of said first set of support bands using a first banding material which has a first yield strength, and at least a second one of the remaining ones of said bands in at least one of said first and second sets of support bands using a second banding material which has a second yield strength different from the first yield strength.

8. A fall protection system as in claim 7 wherein said first band uses said first banding material, and said longitudinal bands, and the remaining ones of said lateral bands, use said second banding material, yield strength of said second banding material being greater than the first yield strength.

9. A fall protection system as in claim 7 wherein said lateral bands, including said first band, use said first banding.

10. A fall protection system as in claim 7 wherein all of said lateral bands, including said first band, use a banding material which has yield strength of 50 ksi to 64 ksi,
tensile strength of 50 ksi to 78 ksi,
elongation of 22% to 37%, and
Rockwell B hardness of 64-79.

11. A fall protection system as in claim 7 wherein said first band is spaced from said first rafter by a distance of no less than 12 inches and no more than 23 inches.

12. A fall protection system as in claim 7 wherein said first band is spaced from said first rafter by a distance of about 14 inches to about 18 inches.

13. A fall protection system as in claim 7 wherein said first band is spaced from said first rafter by a distance of about 16 inches.

14. A fall protection system in a building roof structure, for protecting workers involved in installation of said roof structure, said building roof structure including structural roof elements which include at least first and second rafters, a space between said first and second rafters defining a first distance between said first and second rafters, each said rafter having a length, a top, and opposing first and second ends, said roof structure further comprising an eave, having a length, and extending between the first ends of said first and second rafters, a ridge, having a length, and extending between the second ends of said first and second rafters, and a second distance between said eave and said ridge, said eave and said ridge being disposed on, extending transverse to, and being connected to, the tops of said first and second rafters, and a plurality of intermediate purlins extending between said first and second rafters and spaced from each other between said eave and said ridge, said intermediate purlins being disposed on, and extending transverse to, the tops of said first and second rafters, said fall protection system comprising:

(a) a first set of longitudinal support bands extending from said first rafter to said second rafter and being connected to said building structural roof elements, said first set of longitudinal support bands being spaced along the lengths of said first and second rafters;
(b) a second set of lateral support bands extending from said eave toward said ridge and under said intermediate purlins, said bands of said second set of support bands having first and second end portions which are spaced along the lengths of said eave and said ridge; and
(c) a suspension fabric overlying, and being supported by, said first and second sets of support bands, and being attached to said building structural roof elements, said first and second sets of support bands collectively defining a grid-work of crossing bands,
a first band of said second set of lateral support bands being next adjacent said first rafter,
a second band of said second set of lateral support bands being next adjacent said first band, with said first band between said second band and said first rafter,
a third band of said second set of lateral support bands being next adjacent said second band, with said second band being between said first and third bands,
said first band being spaced from said first rafter by a first distance,
said second band being spaced from said first band by a second distance different from the first distance, and
said third band being spaced from said second band by a third distance different from the first and second distances,
wherein at least said first band uses a first banding material which has a first yield strength, and at least one of the remaining bands in at least one of said first and second sets of support bands uses a second banding material which has a second yield strength greater than the first yield strength.

15. A fall protection system as in claim 14 wherein said first set of bands, including said first band, use the first banding material and said second set of bands use the second banding.

16. A fall protection system as in claim 14 wherein all of said lateral bands, including said first band, use a banding material which has yield strength of 50 ksi to 64 ksi,
tensile strength of 50 ksi to 78 ksi,
elongation of 22% to 37%, and
Rockwell B hardness of 64-79.

17. A fall protection system as in claim 14 wherein said first band is spaced from said first rafter by a distance of 12 inches to 23 inches.

18. A fall protection system as in claim 14 wherein said first band is spaced from said first rafter by a distance of about 14 inches to about 18 inches.

19. A fall protection system as in claim 14 wherein said first band is spaced from said first rafter by a distance of about 16 inches.

20. In a roof structure of a building, the roof structure including structural roof elements which include at least first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a plurality of intermediate purlins extending between the first and second rafters and spaced from each other between the eave and the ridge, the eave, the ridge, and the intermediate purlins being disposed on, and extending transverse to, the tops of the first and second rafters a method of enhancing a prospect of passing a drop test wherein a 400 pound load is dropped from 50.5 inches above a suspension fabric of a fall protection system such that an edge of the load impacts the suspension fabric within 6 inches of a building rafter, the method comprising installing (a) a first set of longitudinal support bands extending from the first rafter to the second rafter and being connected to the building structural roof elements, the first set of longitudinal support bands being spaced along the lengths of the first and second rafters;

(b) a second set of lateral support bands extending from the eave toward the ridge and under the intermediate purlins, the bands of the second set of support bands having first and second end portions which are spaced along the lengths of the eave and the ridge; and (c) a suspension fabric overlying, and being supported by, the first and second sets of support bands, and being attached to the building structural roof elements, a first band of the second set of lateral support bands, next adjacent the first rafter, comprising a safety band, said safety band being disposed at a distance of 12 inches to 23 inches from an edge of the first rafter.

21. A method as in claim 20, including installing a said safety band adjacent each side of each rafter where said safety band will underlie the suspension fabric.

22. A method as in claim 20, including spacing the lateral support bands at generally uniform spacings between the first and second rafters, and adding said safety bands, so spaced, as extra bands, adjacent each rafter where said safety bands will underlie the suspension fabric.

23. A method as in claim 20 wherein the safety band uses a first banding material which has a first yield strength, and at least a second one of the remaining ones of the bands in at least one of the first and second sets of support bands use a second banding material which has a second yield strength different from the first yield strength.

24. A method as in claim 20 wherein the lateral bands, including the safety bands, use a first banding material which has a first yield strength, and the longitudinal bands use a second banding material which has a second yield strength greater than the first yield strength.

25. A method as in claim 20 wherein all of the longitudinal bands, and all of the lateral bands, including the first band, use a banding material which has yield strength of 50 ksi to 64 ksi,
tensile strength of 50 ksi to 78 ksi,
elongation of 22% to 37%, and
Rockwell B hardness of 64-79.

26. A method as in claim 20 wherein the first band is spaced from the first rafter by a distance of about 14 inches to about 18 inches.

27. A method as in claim 20 wherein the first band is spaced from the first rafter by a distance of about 16 inches.

* * * * *